US005735406A

United States Patent [19]

Keffeler

[11] Patent Number: 5,735,406

[45] Date of Patent: Apr. 7, 1998

[54] CARRIER FOR A MEDICATION DISPENSER

[75] Inventor: Paul J. Keffeler, Omaha, Nebr.

[73] Assignee: Opus III-VII, Omaha, Nebr.

[21] Appl. No.: 527,690

[22] Filed: Sep. 13, 1995

[51] Int. Cl.[6] ..... B65D 83/04; B65D 1/24

[52] U.S. Cl. ..... 206/535; 206/538

[58] Field of Search ..... 206/528, 534, 206/534.1, 534.2, 535, 536, 37, 38, 1.5, 581, 538

[56] References Cited

U.S. PATENT DOCUMENTS

| | | | |
|---|---|---|---|
| 4,143,764 | 3/1979 | Moss, III | 220/23.83 X |
| 4,421,127 | 12/1983 | Geer | 206/37 X |
| 4,538,725 | 9/1985 | Glover et al. | 206/37 |
| 5,011,018 | 4/1991 | Keffeler | 206/538 X |
| 5,019,125 | 5/1991 | Rebne et al. | 206/528 X |
| 5,092,354 | 3/1992 | Pacelli, Jr. | 206/581 X |
| 5,107,871 | 4/1992 | Butcher et al. | 206/581 X |
| 5,267,650 | 12/1993 | Gilbilisco | 206/538 X |
| 5,353,947 | 10/1994 | Zinnbauer et al. | 206/581 X |
| 5,423,449 | 6/1995 | Gordon et al. | 220/410 |

*Primary Examiner*—Jacob K. Ackun

*Attorney, Agent, or Firm*—Zarley, McKee, Thomte, Voorhees & Sease; Dennis L. Thomte

[57] ABSTRACT

A carrier for one or more medication dispensers comprising a bottom wall, opposite upstanding side walls and opposite upstanding end walls. At least one of the carrier walls has a retainer thereon for engagement with one of the walls of a dispenser positioned therein for selectively maintaining the dispenser in the carrier. When it is desired to remove the dispenser from the carrier, the retainer is deflected outwardly out of engagement with the wall of the dispenser so that the dispenser may be removed therefrom.

2 Claims, 2 Drawing Sheets

CARRIER FOR A MEDICATION DISPENSER

BACKGROUND OF THE INVENTION

1. Field of the Invention

This invention relates to a carrier, and more particularly to a carrier for one or more medication dispensers.

2. Description of the Related Art

U.S. Pharmacopeia XX defines a unit-dose container as a single-unit container for articles intended for administration by other than the parenteral route as a single dose, direct from the container. A single-unit container is defined as one that is designed to hold a quantity of drugs intended for administration as a single dose or a single finished device intended for use promptly after the container is opened. Accordingly, each compartment of a multiple-unit container must meet the above definitions in order to be used in compliance with current federal regulations.

Applicant has previously patented several medication containers or dispensers. For example, see U.S. Pat. Nos. 4,372,445; 4,735,318; 4,741,441; and 5,011,018. In the use of the medication containers or dispensers of applicant's earlier inventions, the dispenser is not normally filled with medication until the prescription is received. When the prescription has been received, the prescription is filled and the medication is placed in the compartment or compartments of the medication dispenser. At that time, a prescription label is placed on the dispenser. Although the above procedure is satisfactory, some time is required to fill the prescription once the prescription has been received since the prescription cannot be filled in advance.

SUMMARY OF THE INVENTION

A carrier is described for use with a medication dispenser with the dispenser including a bottom wall, opposite upstanding side walls and opposite upstanding end walls. The side walls and the end walls of the dispenser have upper and lower ends. A plurality of individual medication compartments are provided in the dispenser with each of the compartments being sealed and closed by a removable cover element. The carrier of this invention is designed to selectively removably receive one or more of the medication dispensers which are positioned between the end walls and the side walls of the carrier. The carrier comprises a bottom wall, opposite upstanding side walls and opposite upstanding end walls. The side walls and the end walls of the carrier also have upper and lower ends. At least one of the carrier walls has a retainer or latch provided therein for engagement with one of the walls of the dispenser for selectively maintaining the dispenser in the carrier.

Through the use of applicant's carrier, the medication dispenser may be filled with the required medication prior to a prescription being received. Once a prescription is received, the previously filled medication dispenser may be removably positioned in the carrier with a prescription label then being placed on the carrier. The medication may then be delivered to the patient in a much more rapid fashion than the prior art method.

It is therefore a principal object of the invention to provide a carrier for one or more medication dispensers or containers.

A further object of the invention is to provide an improved carrier for a medication dispenser including means thereon for selectively removably receiving the dispenser therein.

Still another object of the invention is to provide a carrier for a medication dispenser which is convenient to use.

These and other objects will be obvious to those skilled in the art.

DESCRIPTION OF THE PREFERRED EMBODIMENT

Figure 1:
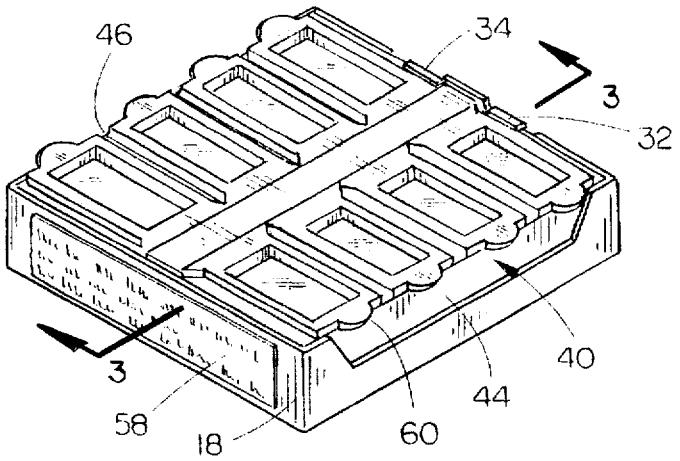
FIG. 1 is a perspective view of the carrier of this invention having a medication dispenser positioned therein.
Figure 2:
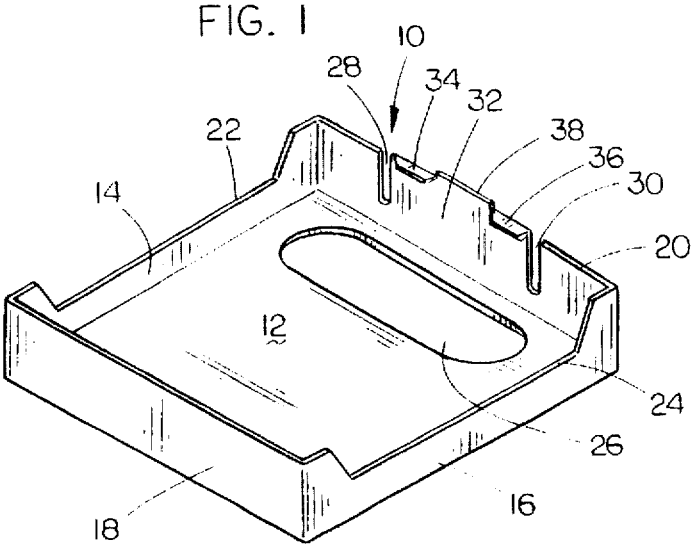
FIG. 2 is a perspective view of the carrier of FIG. 1.
Figure 3:
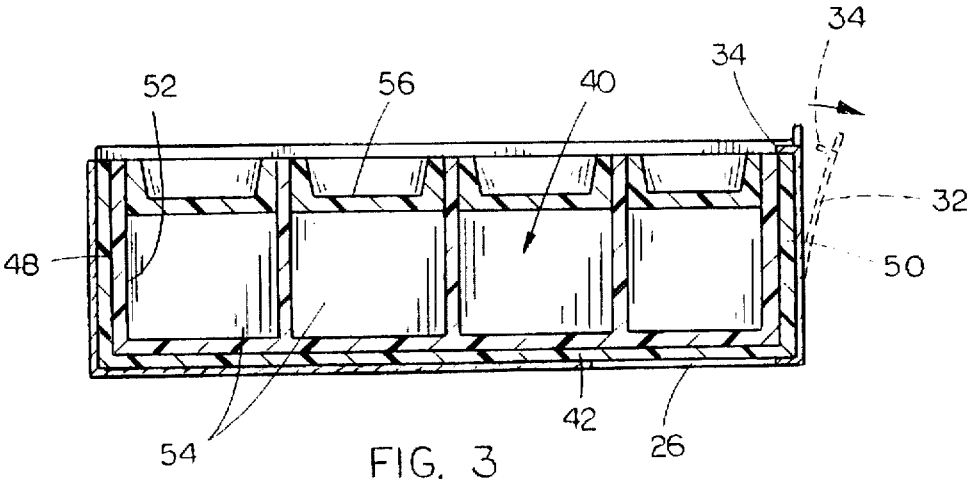
FIG. 3 is a vertical sectional view of the carrier of FIG. 2.
Figure 4:
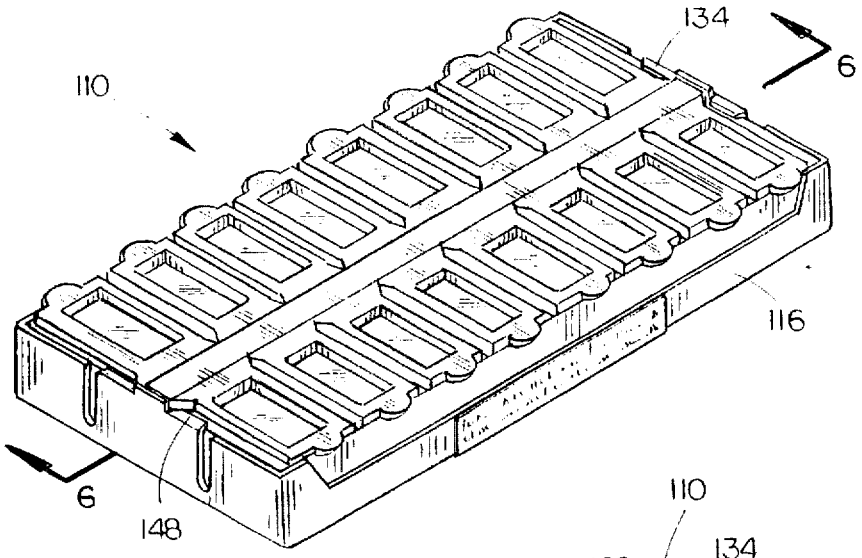
FIG. 4 is a perspective view of a modified form of the carrier having one or more medication dispensers positioned therein.
Figure 5:
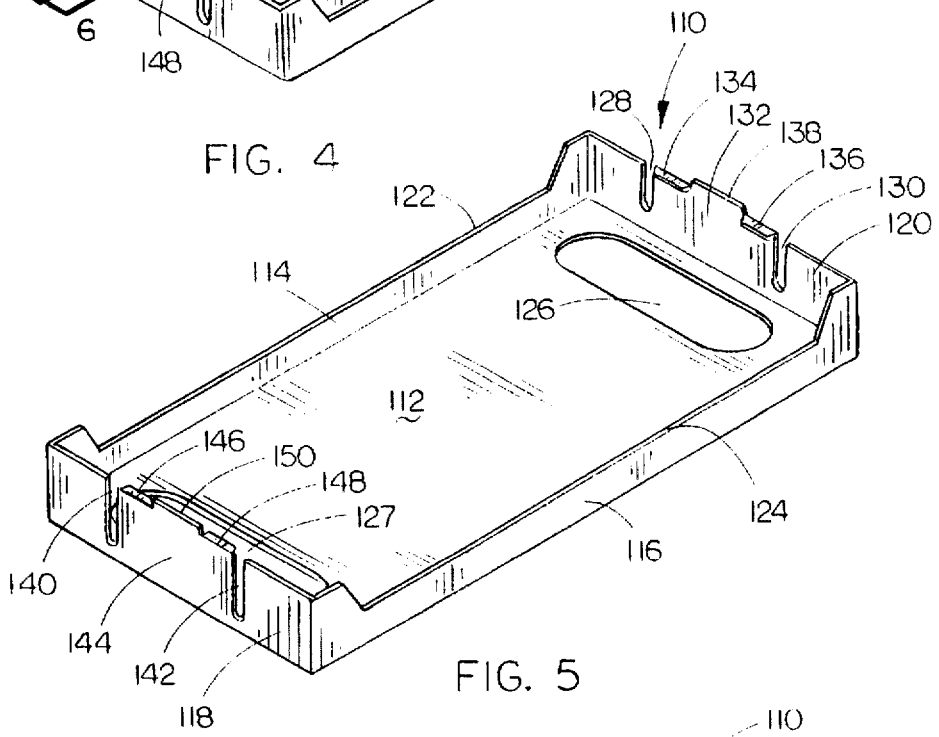
FIG. 5 is a perspective view of the carrier of FIG. 4.
Figure 6:
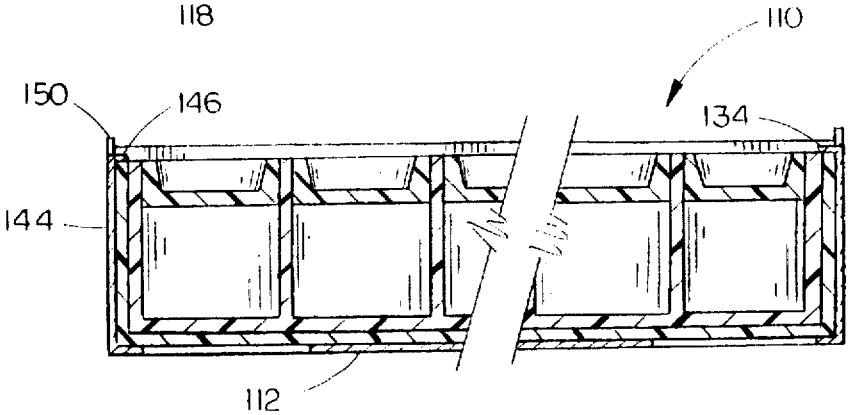
FIG. 6 is a vertical sectional view of the carrier of FIG. 5.

One embodiment of the carrier of this invention is illustrated in FIGS. 1–3, with the numeral 10 referring to the carrier. The numeral 110 refers to a modified form of the carrier as illustrated in FIGS. 4–6.

Referring to the embodiment illustrated in FIGS. 1–3, carrier 10 includes a bottom wall 12, opposite upstanding side walls 14 and 16, and opposite upstanding end walls 18 and 20. The upper ends of side walls 14 and 16 are provided with recessed portions 22 and 24 formed therein, respectively, for a purpose to be described in more detail hereinafter. Bottom wall 12 is provided with an elongated opening 26 formed therein for a purpose to be described in more detail hereinafter.

Carrier 10 is preferably comprised of a suitable plastic material such as polystyrene. Preferably, end wall 20 is provided with a pair of slits or slots 28 and 30 formed therein to define a wall portion 32 which may be deflected outwardly from the carrier, as illustrated in FIG. 3. Wall portion 32 is provided with a retainer means in the form of a pair of latches 34 and 36 which extend inwardly therefrom. The numeral 38 refers to an upper edge portion which extends upwardly above latch members 34 and 36 to enable the wall portion 32 to be engaged by a thumb or finger.

The numeral 40 refers to a medication container or dispenser such as disclosed in U.S. Pat. Nos. 4,372,445; 4,735,318; 4,741,441; and 5,011,018. The dispenser 40 includes a bottom wall 42, upstanding side walls 44 and 46, and upstanding end walls 48 and 50. Normally, a liner 52 is provided in the dispenser 40 to define a plurality of compartments 54, each of which are removably sealed by a cover 56.

Prior to a prescription being received, the dispenser 40 may be filled with a suitable and commonly dispensed medication with some sort of an identification placed thereon. When a prescription is received, the filled dispenser 40 may be positioned in the carrier 10 in the manner illustrated in FIGS. 1 and 3. When the dispenser 40 is positioned in the carrier 10, latch members 34 and 36 extend over the upper portion of end wall 50, as illustrated in FIG. 3, to yieldably maintain the dispenser 40 in carrier 10. Prescription label 58 is then placed on end wall 18, as illustrated in FIG. 1. The carrier 10 and the dispenser 40 positioned therein is then delivered to the patient.

In use, the recessed portions 22 and 24 on side walls 14 and 16 permit access to the tabs 60 on the covers 56. Once the prescription has been completely consumed, the carrier 10 with the empty dispenser 40 therein may be returned to the pharmacy. The empty dispenser is easily removed from the carrier 10 by simply grasping the upper edge 38 and deflecting the wall portion 32 outwardly, as viewed in FIG. 3, to disengage the latches 34 and 36. The person may then insert a finger or thumb upwardly through opening 26 to push the dispenser 40 upwardly from the carrier 10. The carrier 10 may then be reused with a new prescription label 58 being utilized. The carrier 110 of FIGS. 4–6 is essentially identical to carrier 10 except that carrier 110 is larger than carrier 10 so as to be able to accommodate a large dispenser or one or more dispensers. Carrier 110 includes a bottom wall 112, opposite upstanding side walls 114 and 116, and opposite upstanding end walls 118 and 120. The upper ends of side walls 114 and 116 are provided with recess portions 122 and 124 formed therein, respectively, which serve the same purpose as recess portions 22 and 24 in carrier 10. Bottom wall 112 is provided with elongated openings 126 and 127 formed therein to serve the same purpose as the opening 26 in carrier 10.

Carrier 110 is also preferably comprised of a suitable plastic material such as a polystyrene. Preferably, end wall 120 is provided with a pair slits or slots 128 and 130 formed therein to define a wall portion 132 which may be deflected outwardly from the carrier 110 in a manner similar to the wall portion 32 in carrier 10. Wall portion 132 is provided with a retainer means in the form of a pair of latches 134 and 136 to extend inwardly therefrom. The numeral 138 refers to an upper edge portion which extends upwardly above latch members 134 and 136 to enable the wall portion 132 to be engaged by a thumb or finger.

It is also preferred that end wall 118 be provided with a pair of slits or slots 140 and 142 formed therein to define a wall portion 144 which may be deflected outwardly from the carrier. Wall portion 144 is provided with a retainer means in the form of a pair of latches 146 and 148 which extend inwardly therefrom. The numeral 150 refers to an upper edge portion which extends upwardly above latch members 146 and 148 to enable the wall portion 144 to be engaged by a thumb or finger.

Carrier 110, as stated, is adapted to receive a larger medication dispenser than carrier 10. The carrier 110 is also designed to accommodate two or more medication dispensers if so desired. Although the carrier 110 does not have to have the latches on both of the end walls 132 and 144, it is recommended that latches be provided on each of the end walls for the sake of convenience. Further, the opening 127 is also recommended in addition to the opening 126 for convenience purposes. The carrier 110 is used in the same fashion as the carrier 10. Thus it can be seen that the carrier of FIGS. 1–3 accomplishes at least all of its stated objectives.

I claim:

1. In combination:

a medication dispenser carrier comprising a bottom wall, opposite upstanding side walls and opposite upstanding end walls, said side walls and said end walls of said carrier having upper and lower ends;

a medication dispenser selectively removably positioned in said carrier between said side walls and said end walls thereof;

said medication dispenser including a bottom wall, opposite upstanding side walls and opposite upstanding end walls, said side walls and said end walls of said dispenser having upper and lower ends, and a cover means extending between the upper ends of said side walls and said end walls of said dispenser;

at least one of said carrier walls having retainer means thereon for engagement with one of said walls of said dispenser for selectively maintaining said dispenser in said carrier;

said carrier bottom wall having an opening formed therein.

2. In combination:

a medication dispenser carrier comprising a bottom wall, opposite upstanding side walls and opposite upstanding end walls, said side walls and said end walls of said carrier having upper and lower ends;

a medication dispenser selectively removably positioned in said carrier between said side walls and said end walls thereof;

said medication dispenser including a bottom wall, opposite upstanding side walls and opposite upstanding end walls, said side walls and said end walls of said dispenser having upper and lower ends, and a cover means extending between the upper ends of said side walls and said end walls of said dispenser;

at least one of said carrier walls having retainer means thereon for engagement with one of said walls of said dispenser for selectively maintaining said dispenser in said carrier;

said retainer means being provided on both of said carrier end walls;

said carrier bottom wall having a first opening formed therein adjacent one of said carrier end walls and having a second opening formed therein adjacent the other of said carrier end walls.

* * * * *